US007357651B2

(12) United States Patent
Minoura et al.

(10) Patent No.: US 7,357,651 B2
(45) Date of Patent: Apr. 15, 2008

(54) FEMALE CONNECTOR, FEMALE CONNECTOR MOUNTING STRUCTURE, AND METHOD OF MOUNTING FEMALE CONNECTOR TO SUBSTRATE

(75) Inventors: Akihiro Minoura, Niwa-gun (JP); Toshihiro Takeuchi, Niwa-gun (JP); Norihito Suzuki, Niwa-gun (JP); Shuichi Inoue, Yamato (JP); Akira Kawaguchi, Yamato (JP)

(73) Assignees: Kabushiki Kaisha Tokai-Rika-Denki-Seisakusho, Aichi-ken (JP); Molex Japan Co., Ltd., Kanagawa (JP)

( * ) Notice: Subject to any disclaimer, the term of this patent is extended or adjusted under 35 U.S.C. 154(b) by 0 days.

(21) Appl. No.: 11/560,073

(22) Filed: Nov. 15, 2006

(65) Prior Publication Data

US 2007/0149015 A1 Jun. 28, 2007

(30) Foreign Application Priority Data

Nov. 16, 2005 (JP) ..... 2005-331710

(51) Int. Cl.
*H01R 12/00* (2006.01)

(52) U.S. Cl. ..... 439/82; 439/876

(58) Field of Classification Search ..... 439/82, 439/83, 857, 876

See application file for complete search history.

(56) References Cited

U.S. PATENT DOCUMENTS 4,585,295 A * 4/1986 Ackerman ..... 439/857
4,657,336 A * 4/1987 Johnson et al. ..... 439/852
4,950,171 A * 8/1990 Muzslay ..... 439/76.1
5,131,853 A * 7/1992 Meyer ..... 439/82
5,169,322 A * 12/1992 Frantz et al. ..... 439/82
5,362,244 A * 11/1994 Hanson et al. ..... 439/82
5,975,963 A * 11/1999 Higuchi et al. ..... 439/851
6,129,558 A * 10/2000 Kihira et al. ..... 439/66

FOREIGN PATENT DOCUMENTS

JP 11-67298 A 3/1999

* cited by examiner

*Primary Examiner*—Thanh-Tam Le
(74) *Attorney, Agent, or Firm*—Roberts, Mlotkowski & Hobbes; Thomas W. Cole

(57) ABSTRACT

A single pole female connector has: a mounting base portion in which is formed a terminal insertion hole into which a male terminal can be inserted; an extending portion extending outwardly from the mounting base portion; and a terminal contacting portion which extends from a peripheral edge of the mounting base portion in a direction substantially orthogonal to a plate portion, and which is formed so as to be able to nip the male terminal. The extending portion is electrically connected by being reflow soldered to a land at a reverse surface of the substrate. It is difficult for cream solder to enter into a male terminal insertion path at an inner side of the female connector.

13 Claims, 4 Drawing Sheets

FEMALE CONNECTOR, FEMALE CONNECTOR MOUNTING STRUCTURE, AND METHOD OF MOUNTING FEMALE CONNECTOR TO SUBSTRATE

CROSS-REFERENCE TO RELATED APPLICATION

This application claims priority under 35 USC 119 from Japanese Patent Application No. 2005-331710, the disclosure of which is incorporated by reference herein.

BACKGROUND OF THE INVENTION

1. Field of the Invention

The present invention relates to a female connector which is disposed at a substrate, a female connector mounting structure, and a method of mounting a female connector to a substrate.

2. Description of the Related Art

In mounting a female connector, structures are known in which soldering is carried out in order to securely mount the female connector to a printed substrate (see, for example, Japanese Patent Application Laid-Open (JP-A) No. 11-67298). In this mounting, in a state in which a terminal of a female connector is inserted into a mounting hole of a printed substrate, molten solder is jetted and soldering is carried out.

In this conventional female connector mounting structure, it is easy for solder to enter into a male terminal insertion path at the inner side of the female connector via a through-hole of the printed substrate.

SUMMARY OF THE INVENTION

In view of the aforementioned, an object of the present invention is to provide a female connector mounting structure in which it is difficult for solder to enter into a male terminal insertion path at an inner side of a female connector.

A female connector mounting structure of a first aspect of the present invention has: a mounting base portion which is fit into a hole of a substrate, and in which is formed a terminal insertion portion into which a male terminal can be inserted; an extending portion extending from the mounting base portion, and disposed at an outer side of the hole, and being electrically connected to an electrode of the substrate by reflow soldering; and a terminal contacting portion which extends from the mounting base portion in a direction toward a side of the substrate opposite a side where the extending portion is located in a mounted state, the terminal contacting portion nipping the male terminal.

In accordance with the female connector mounting structure of the above-described aspect, when the male terminal is inserted, the male terminal is inserted into the terminal insertion portion and is nipped by the terminal contacting portion. In this way, the male terminal is electrically connected to the electrode of the substrate via the mounting base portion and the extending portion. Here, the terminal insertion portion is formed in the mounting base portion which is fit-in the hole of the substrate, and the extending portion is electrically connected to the electrode of the substrate by reflow soldering. Therefore, it is difficult for solder to enter into a male terminal insertion path at an inner side of the female connector.

In the female connector mounting structure of the above-described aspect, a cut-out portion may be formed in a portion which is reflow soldered of the extending portion.

In accordance with the female connector mounting structure having the above-described structure, air within the solder can be vented-out from the cut-out portion at the time of the reflow soldering.

In the female connector mounting structure of the above-described aspect, an intermediate portion of the extending portion, which intermediate portion connects the mounting base portion and a portion which is reflow soldered, may be bent with respect to the mounting base portion.

In accordance with the female connector mounting structure having the above-described structure, even if thermal stress is applied to the extending portion accompanying the reflow soldering, the intermediate portion absorbs the thermal stress.

As described above, the female connector mounting structure of the present invention has the excellent effect that it is difficult for solder to enter into a male terminal insertion path at an inner side of a female connector.

A second aspect of the present invention is a female connector having: a mounting base portion having a plate portion which is substantially rectangular, and a terminal insertion portion, into which a male terminal can be inserted, is formed on the plate portion; an extending portion extending outwardly from a peripheral edge of the plate portion and having a surface which is substantially parallel to the plate portion, the extending portion being electrically connected by reflow soldering to an electrode of a substrate to which the connector is mounted; and a terminal contacting portion extending from a peripheral edge of the mounting base portion in a direction substantially orthogonal to the plate portion, and formed so as to be able to nip the male terminal.

A third aspect of the present invention is a method of mounting a female connector to a substrate, including the steps of: providing a substrate in which a hole, for fitting-in of a female connector, is formed, and which has a land at a periphery thereof; supplying cream solder on the land; providing a female connector which is structured so as to have: (a) a mounting base portion having a plate portion which is substantially rectangular, and a terminal insertion portion, into which a male terminal can be inserted, is formed on the plate portion, (b) an extending portion extending outwardly from a peripheral edge of the plate portion and having a surface which is substantially parallel to the plate portion, the extending portion being electrically connected by reflow soldering to an electrode of a substrate to which the connector is mounted, and (c) a terminal contacting portion extending from a peripheral edge of the mounting base portion in a direction substantially orthogonal to the plate portion, and formed so as to be able to nip the male terminal; fitting the female connector into the hole of the substrate, and positioning the extending portion on the cream solder; fusing the cream solder by heating the substrate; and solidifying the cream solder by cooling the substrate.

BRIEF DESCRIPTION OF THE DRAWINGS

1), where FIG. 2A shows a state in which the single pole female connector is set in the substrate, and FIG. 2B shows a state in which cream solder is fused;

DETAILED DESCRIPTION OF THE INVENTION

Figure 1:
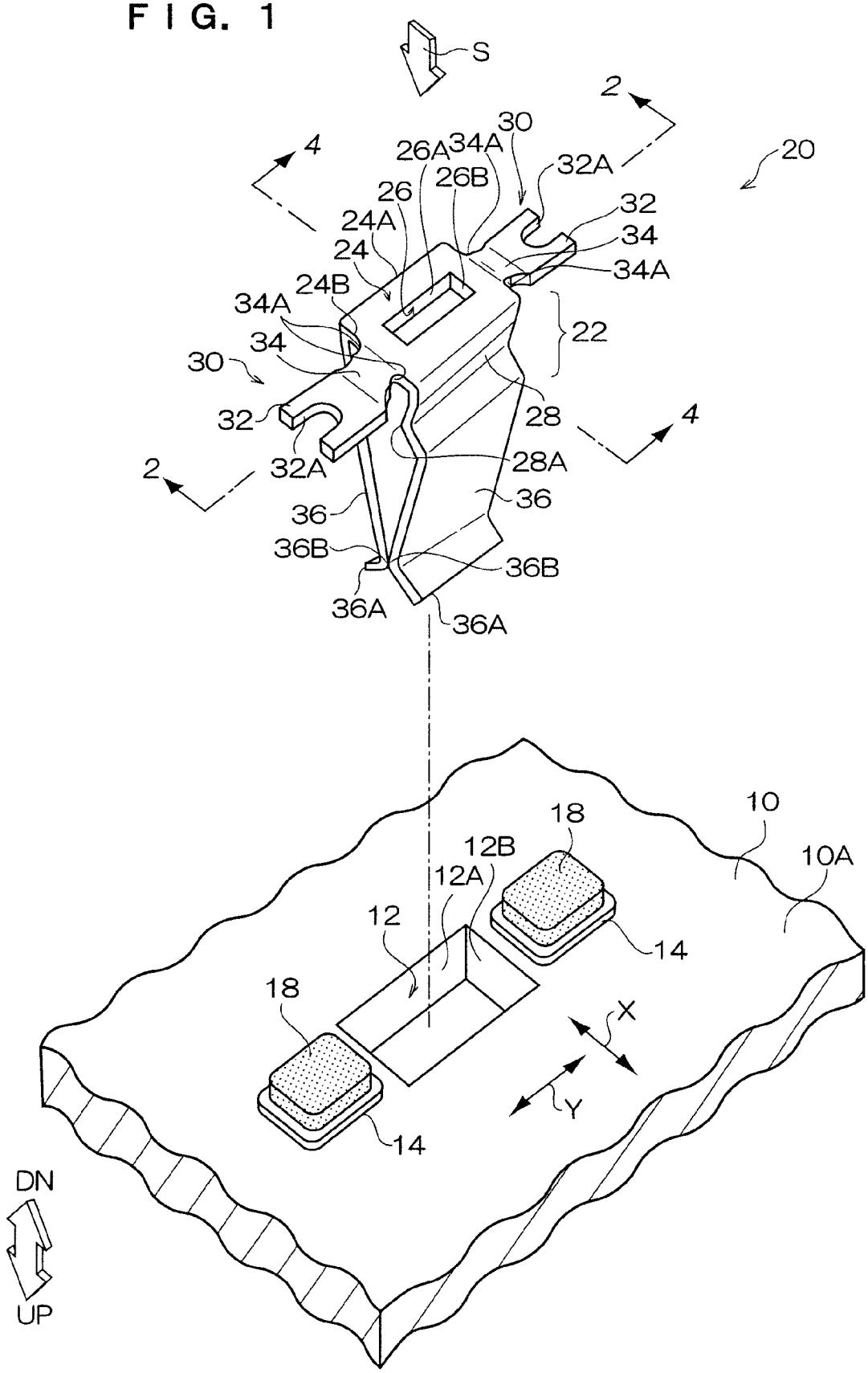
FIG. 1 is a perspective view showing a single pole female connector and a substrate in an embodiment of the present invention.

An embodiment of a female connector mounting structure in the present invention will be described on the basis of the drawings. Note that arrow UP in the drawings indicates the direction facing from the reverse surface toward the obverse of a substrate, and arrow DN indicates the direction facing from the obverse toward the reverse surface of the substrate.

A substrate 10, and a single pole female connector 20 which serves as a female connector and which is mounted to the substrate 10, are shown in FIG. 1.

As shown in FIG. 1, a through-hole 12, which serves as a hole and which passes through the obverse and reverse of the substrate 10, is formed in the substrate 10. The configuration of the through-hole 12 in plan view is rectangular. The through-hole 12 has long side portions 12A and short side portions 12B, and is for insertion of the single pole female connector 20 (details will be described later). The dimensions of the long side portions 12A and short side portions 12B of the through-hole 12 are large as compared with the longitudinal and transverse direction dimensions, of a cross-section which is orthogonal to an insertion direction (the direction of arrow S), of a male terminal 40 (see FIGS. 3 and 4) which is inserted in the single pole female connector 20.

Lands 14 serving as electrodes are formed in vicinities of the short side portions 12B of the through-hole 12 on a reverse surface 10A of the substrate 10 shown in FIG. 1. The lands 14 are electrically connected to electric elements (diodes, transistors, capacitors, or the like) via an unillustrated wiring pattern. In the state in which the single pole female connector 20 is mounted to the substrate 10, the lands 14 are electrically connected to the single pole female connector 20.

Figure 4:
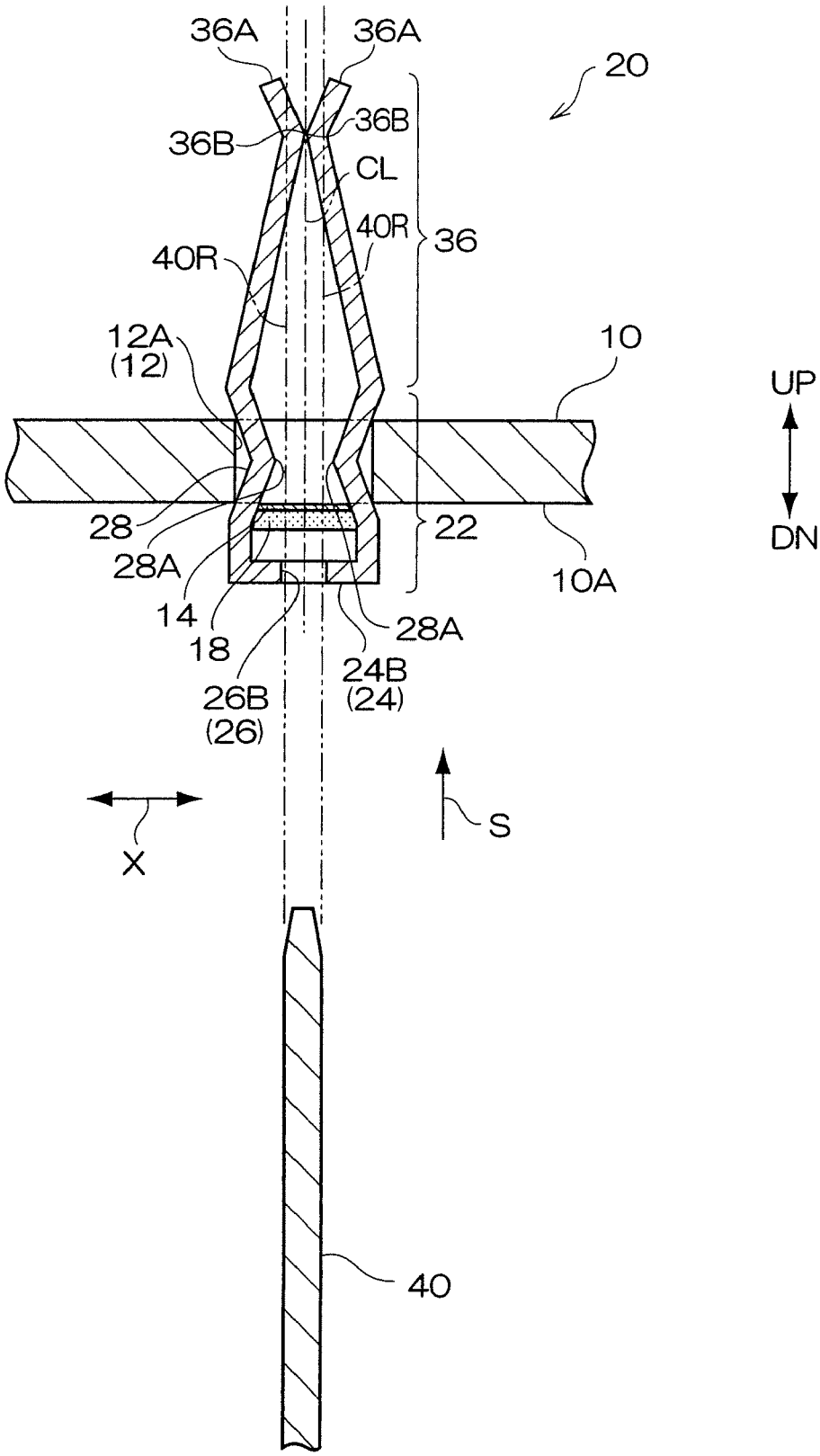
FIG. 4 is a cross-sectional view showing the female connector mounting structure relating to the embodiment of the present invention (showing a cross-section corresponding to the cross-section of line 4-4 of FIG. 1).

As shown in FIG. 4, the single pole female connector 20 which is mounted to the substrate 10 has a mounting base portion 22 which is fit-into the through-hole 12 of the substrate 10. As shown in FIG. 1, the mounting base portion 22 is structured by a plate portion 24, which, in plan view, is substantially rectangular and has long side portions 24A and short side portions 24B, and mounting piece portions 28, which are flexible and extend from the long side portions 24A of the plate portion 24 respectively and are disposed within the through-hole 12 of the substrate 10.

A terminal insertion hole 26, which serves as a terminal insertion portion and is rectangular in plan view, is formed in the plate portion 24 so as to pass through the central portion thereof. The terminal insertion hole 26 has long side portions 26A which are parallel to the long side portions 24A, and short side portions 26B which are parallel to the short side portions 24B. The surface area of the opening of the terminal insertion hole 26 is small as compared with that of the through-hole 12 of the substrate 10. The male terminal 40 (see FIGS. 3 and 4), which is provided at an insulator (not shown) which is fit-together with the substrate 10, can be inserted into the terminal insertion hole 26. Here, in FIGS. 1, 3 and 4, the direction of insertion of the male terminal 40 into the terminal insertion hole 26 is shown by arrow S, and, in FIGS. 3 and 4, the path of insertion of the male terminal 40 is shown by the range between the two-dot chain lines 40R (hereinafter called "male terminal insertion path 40R").

As shown in FIG. 4, the pair of mounting piece portions 28 are shaped so as to have line symmetry with respect to a central line CL in the cross-sectional view of FIG. 4. The intermediate portions of the mounting piece portions 28 are bent portions 28A which approach one another. In the state in which the single pole female connector 20 is mounted, these bent portions 28A are disposed at the intermediate portion of the through-hole 12 in the direction in which the through-hole 12 passes-through. The portions of the pair of mounting piece portions 28 which are above and below the bent portions 28A extend in directions of moving apart from one another. In the state in which the single pole female connector 20 is mounted, the mounting piece portions 28 contact the pass-through direction both end portions (i.e., the upper portions and the lower portions) of the inner peripheral surfaces at the long side portions 12A of the through-hole 12. Here, because the mounting piece portions 28 urge the long side portions 12A of the through-hole 12 in the pushing direction, the single pole female connector 20 is positioned in the direction (the direction of arrow X) in which the short side portions 12B (see FIG. 1) extend.

Figure 3:
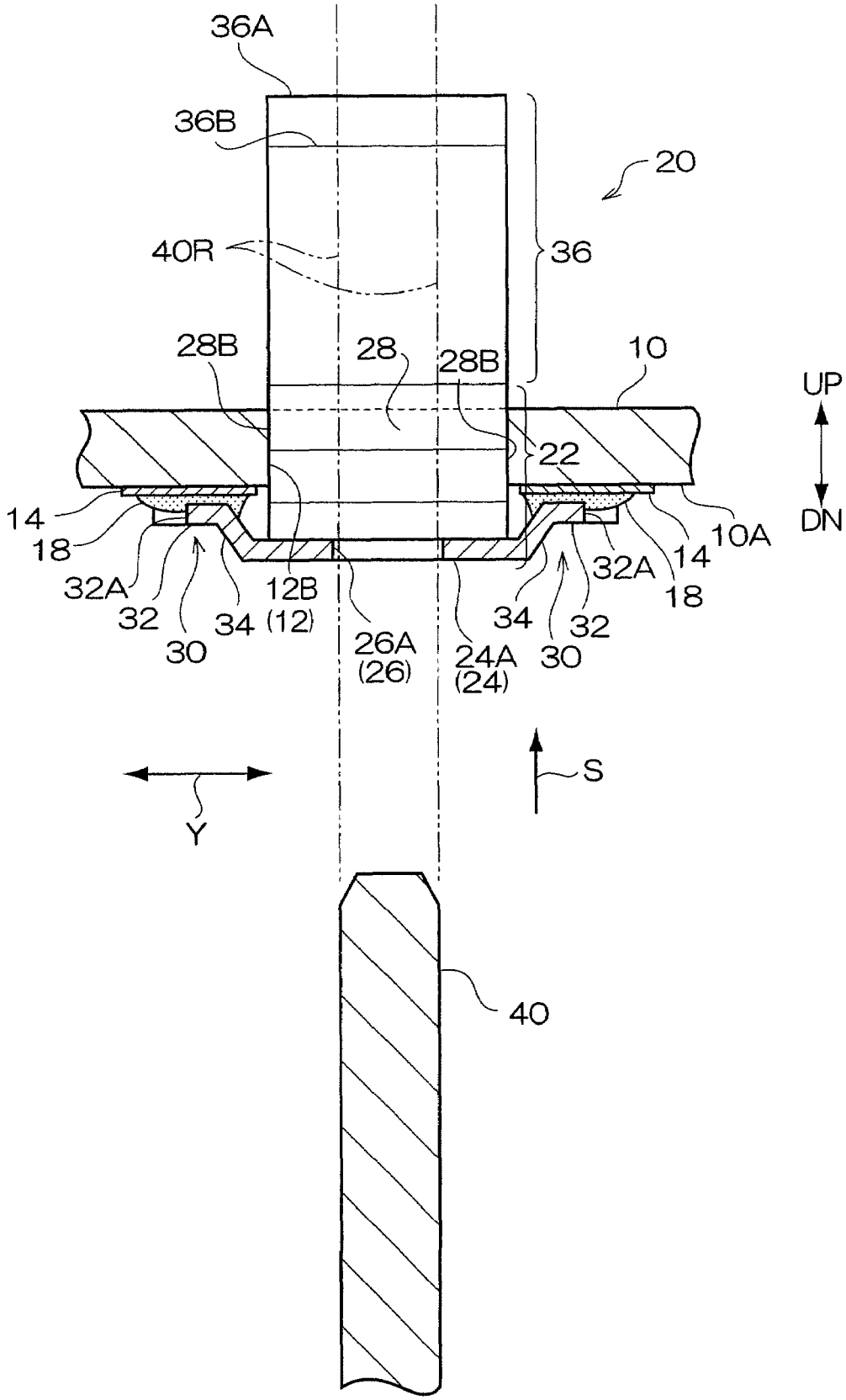
FIG. 3 is a cross-sectional view showing a female connector mounting structure relating to the embodiment of the present invention (showing a cross-section corresponding to the cross-section of line 2-2 of FIG. 1)

Further, as shown in FIG. 3, the transverse dimension of the mounting piece portion 28 (i.e., the dimension thereof in the left-right direction in FIG. 3) is a dimension which is substantially equal to the lateral dimension (the dimension in the direction of arrow Y in FIG. 1) of the long side portion 12A (see FIG. 1) of the through-hole 12. In the state in which the single pole female connector 20 is mounted, side portions 28B of the mounting piece portions 28 exactly planarly-contact the inner peripheral surfaces of the short side portions 12B of the through-hole 12. The single pole female connector 20 is thereby positioned in the direction (the direction of arrow Y) in which the long side portions 12A (see FIG. 1) extend.

As shown in FIG. 1, arm portions 30 serving as extending portions extend-out from the short side portions 24B of the plate portion 24 of the mounting base portion 22, in the directions in which the long side portions 24A extend. The distal end portions 30 of the arm portions 30 are soldering portions 32. The soldering portions 32 are disposed at the outer side of the through-hole 12, and are electrically connected to the lands 14 of the substrate 10 by reflow soldering.

Figure 2A:
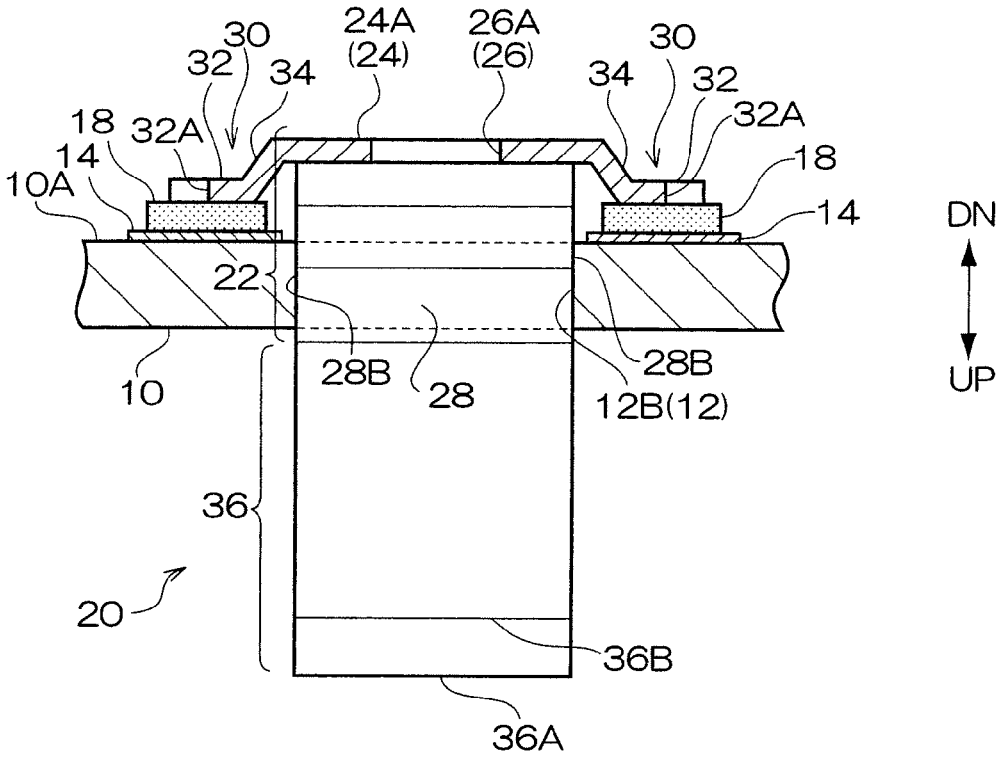
FIGS. 2A and 2B are cross-sectional views showing processes of mounting the single pole female connector in the embodiment of the present invention (showing a cross-section corresponding to the cross-section of line 2-2 in FIG.

In the reflow soldering, as shown in FIG. 2A, in a state in which the cream solder 18 which contains a solder paste is placed on the lands 14 and the soldering portions 32 are set on the cream solder 18, the cream solder 18 is fused. The lands 14 and the soldering portions 32 are thereby connected as shown in FIG. 2B.

As shown in FIG. 1, cut-out portions 32A, which are cut-out in semicircular shapes, are formed in the soldering portions 32. The cut-out portions 32A are for venting air (as a countermeasure to voids) for discharging the air within the solder at the time of the reflow soldering.

Figure 2B:
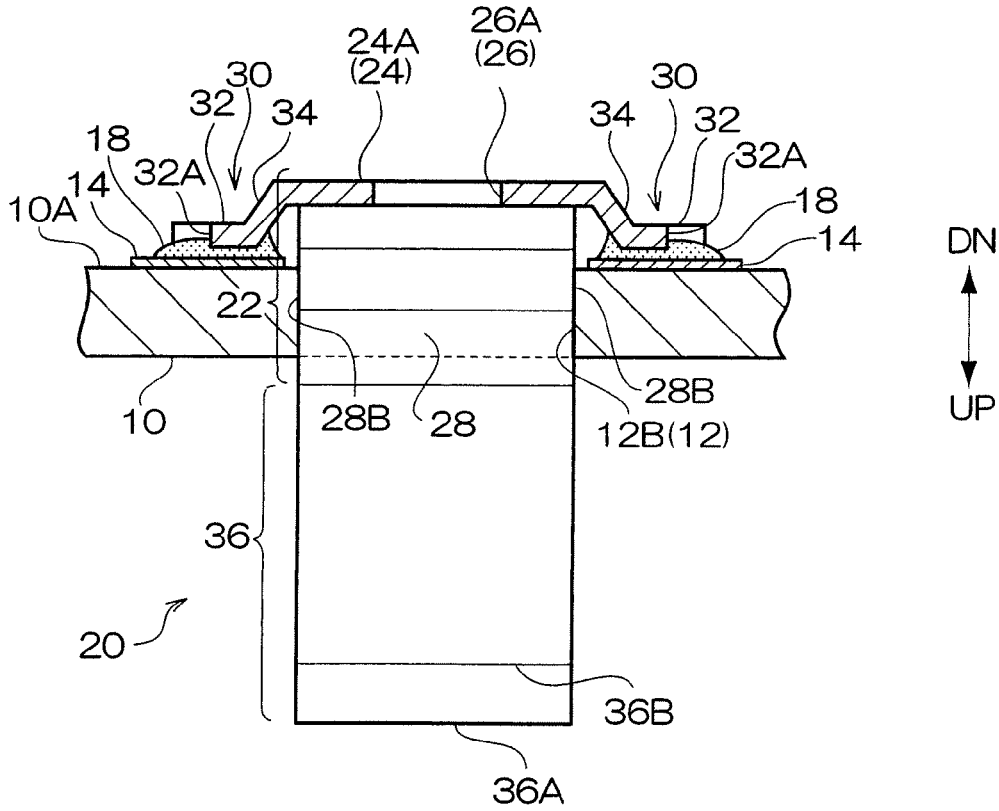

As shown in FIGS. 1, 2A and 2B, an intermediate portion 34 of the arm portion 30, which intermediate portion 34 connects the plate portion 24 of the mounting base portion 22 and the soldering portion 32 which is reflow soldered, is bent and inclined with respect to the plate portion 24 of the mounting base portion 22 so as to be formed in a so-called gull-wing shape. The portions of the intermediate portion 34 which are toward the plate portion 24 are constricted, and are constricted portions 34A (see FIG. 1). Even in the state in which thermal stress is applied to the arm portions 30 accompanying the reflow soldering, the thermal stress is absorbed by the intermediate portions 34.

As shown in FIG. 3, contacting piece portions 36 serving as terminal contacting portions extend from the mounting piece portions 28 of the mounting base portion 22, in the direction of the side of the substrate 10 opposite the side where the arm portions 30 are located in the mounted state.

As shown in FIG. 4, the pair of contacting piece portions 36 are flexible, and are shaped so as to have line symmetry with respect to the central line CL in the cross-sectional view of FIG. 4, and nip the male terminal 40 which is inserted in the single pole female connector 20. The pair of contacting piece portions 36 extend in directions of approaching one another from the mounting piece portion 28 sides thereof toward distal end portion 36A sides thereof (i.e., upward in FIG. 4), and have, in vicinities of the distal end portions 36A, nipping portions 36B which contact one another in the usual state in which the male terminal 40 is not nipped therebetween. The portions of the contacting piece portions 36 which are further toward the distal end portion 36A sides than the nipping portions 36B extend in directions of moving away from one another.

The work of mounting the single pole female connector 20 to the substrate 10 and the operation of the above-described embodiment will be described hereinafter.

First, as shown in FIG. 1, the cream solder 18 is printed on the lands 14 of the substrate 10. Next, an unillustrated mounter inserts the contacting piece portions 36 of the single pole female connector 20 into the through-hole 12 from the reverse surface 10A side of the substrate 10, and fits the mounting piece portions 28 (see FIG. 4) into the through-hole 12, and places the soldering portions 32 on the cream solder 18, as shown in FIG. 2A.

Next, the substrate 10 is heated by an unillustrated heater (reflow heating), and as shown in FIG. 2B, the cream solder 18 is fused. At this time, due to the fusing of the cream solder 18 and the load from the single pole female connector 20, the soldering portions 32 are, while moving slightly toward the lands 14, connected to the lands 14 via the cream solder 18.

Here, because the air within the solder is vented from the cut-out portions 32A, the occurrence of voids can be suppressed. Further, even if thermal stress is applied to the arm portions 30 accompanying the reflow soldering, because the thermal stress is absorbed by the displacement of the intermediate portions 34, the thermal stress of the soldering portions 32 can be mitigated.

Next, by cooling the substrate 10, the cream solder 18 is solidified, and the work of mounting the single pole female connector 20 to the substrate 10 is completed.

Due to this reflow soldering, the soldering portions 32 and the lands 14 are electrically connected and are adhered, and movement of the single pole female connector 20 in vertical directions is limited.

As described above, the terminal insertion hole 26 shown in FIGS. 3 and 4 is formed in the mounting base portion 22 which is fit in the through-hole 12 of the substrate 10. By making the dimensions of the through-hole 12 be larger than those of the terminal insertion hole 26, it is difficult for solder to enter into the male terminal insertion path 40R at the inner side of the single pole female connector 20.

Further, because reflow soldering is used, the amount of the cream solder 18 (solder) is limited to the amount printed in advance.

Moreover, when the single pole female connector 20 is set in the posture shown in FIGS. 2A and 2B and the cream solder 18 is fused, the position at which the terminal insertion hole 26 is located is further upward than the position at which the cream solder 18 is located. Therefore, the cream solder 18 can be prevented from entering into the terminal insertion hole 26.

Namely, in the present embodiment, because the intermediate portions 34 of the arm portions 30 shown in FIGS. 2A and 2B extend toward the plate portion 24 at an incline in the direction of moving away from the substrate 10, the cream solder 18 (solder) can effectively be prevented from flowing to the terminal insertion hole 26.

In accordance with the mounting structure of the single pole female connector 20 of the present embodiment, even if a so-called lead-free solder whose solidification point and viscosity are high is used as the cream solder 18 of the above-described embodiment, the male terminal insertion path 40R can be effectively ensured. Therefore, clogging of holes by lead-free solder, which is problematic in conventional techniques, can be overcome.

Note that, by fitting the mounting piece portions 28 into the through-hole 12, the single pole female connector 20 is positioned in the lateral directions (the direction of arrow Y in FIG. 3 and the direction of arrow X in FIG. 4), and, due to the reflow soldering, vertical direction movement of the single pole female connector 20 is limited. Therefore, although the single pole female connector 20 is compact, it can be securely fixed to the substrate 10.

Further, the above embodiment describes the single pole female connector 20 as an example of the female connector. However, the female connector may be another female connector such as, for example, a multipole female connector, or the like.

What is claimed is:

1. A female connector mounting structure comprising:

a mounting base portion including a flat plate portion, said mounting base portion being fit into a hole of a substrate, and in which is formed a terminal insertion portion into which a male terminal can be inserted, said terminal insertion portion being substantially smaller than said hole that said mounting base portion fits into;

an extending portion extending from and beneath the plate portion of the mounting base portion, and disposed at an outer side of the hole, and being electrically connected to an electrode of the substrate by reflow soldering such that said plate portion is raised above said extending portion; and a terminal contacting portion which extends from the mounting base portion in a direction toward a side of the substrate opposite a side where the extending portion is located in a mounted state, the terminal contacting portion nipping the male terminal;

wherein a width of said terminal insertion portion is less than half of a width of said flat plate portion.

2. The female connector mounting structure of claim 1, wherein the extending portion has a portion which is reflow soldered, and wherein the raised position of said mounting base portion relative to said extending portion prevents solder from flowing through said terminal insertion portion, and a cut-out portion is formed in the portion.

3. The female connector mounting structure of claim 1, wherein the extending portion includes an intermediate portion which connects the mounting base portion and a portion which is reflow soldered and that absorbs thermal stress during soldering, the intermediate portion being bent with respect to the mounting base portion.

4. The female connector mounting structure of claim 1, wherein the female connector is a single pole connector.

5. The female connector mounting structure of claim 1, wherein the plate portion is substantially rectangular and the mounting base portion further includes a mounting side portion which extends from a peripheral edge of the plate portion, and the terminal contacting portion extends from the mounting side portion.

6. The female connector mounting structure of claim 5, wherein the extending portion extends from the peripheral edge of the plate portion.

7. A female connector comprising:

a mounting base portion and having a flat plate portion which is substantially rectangular, and a terminal insertion portion including an opening in said plate portion that is substantially smaller in area than said plate portion, into which a male terminal can be inserted;

an extending portion extending outwardly from and beneath a peripheral edge of the plate portion and having a surface which is substantially parallel to the plate portion, the extending portion being electrically connected by reflow soldering to an electrode of a substrate to which the connector is mounted such that said plate portion of said mounting base portion is raised above said extending portion; and a terminal contacting portion extending from a peripheral edge of the mounting base portion in a direction substantially orthogonal to the plate portion, and formed so as to be able to nip the male terminal;

wherein a width of said opening of said terminal insertion portion is less than half of a width of said flat plate portion of said mounting base portion.

8. The female connector of claim 7, wherein, by having flexibility, the terminal contacting portion works so as to nip the male terminal.

9. The female connector of claim 7, wherein the extending portion has a portion which is reflow soldered, and wherein the raised position of said plate portion of said mounting base portion relative to said extending portion prevents solder from flowing through said terminal insertion portion, and a cut-out portion is formed in the portion.

10. The female connector of claim 7, wherein the extending portion includes an intermediate portion which connects the mounting base portion and a portion which is reflow soldered and that absorbs thermal stress during soldering, the intermediate portion being bent with respect to the mounting base portion.

11. The female connector of claim 7, wherein the female connector is a single pole connector.

12. The female connector of claim 7, wherein the mounting base portion includes a mounting side portion which extends from a peripheral edge of the plate portion, and the terminal contacting portion extends from the mounting side portion.

13. The female connector of claim 12, wherein the extending portion extends from the peripheral edge of the plate portion.

* * * * *